US009067656B2

(12) United States Patent
Rasmussen et al.

(10) Patent No.: US 9,067,656 B2
(45) Date of Patent: Jun. 30, 2015

(54) INFLATABLE UNIT FOR A LIFE-SAVING EQUIPMENT

(75) Inventors: Gert Smedmann Rasmussen, Esbjerg N (DK); Christian Tovdal Jeppesen, Esbjerg V (DK)

(73) Assignee: VIKING LIFE SAVING EQUIPMENT A/S, Esbjerg (DK)

( * ) Notice: Subject to any disclaimer, the term of this patent is extended or adjusted under 35 U.S.C. 154(b) by 66 days.

(21) Appl. No.: 14/119,620

(22) PCT Filed: May 23, 2012

(86) PCT No.: PCT/EP2012/059565

§ 371 (c)(1),
(2), (4) Date: Nov. 22, 2013

(87) PCT Pub. No.: WO2012/160081

PCT Pub. Date: Nov. 29, 2012

(65) Prior Publication Data

US 2014/0087610 A1 Mar. 27, 2014

(30) Foreign Application Priority Data

May 24, 2011 (DK) ..... 2011 70257

(51) Int. Cl.

| | |
|---|---|
| ***B63B 35/613*** | (2006.01) |
| ***B63C 9/04*** | (2006.01) |
| ***B63B 7/08*** | (2006.01) |
| *B63C 9/02* | (2006.01) |

(52) U.S. Cl.

CPC ... *B63C 9/04* (2013.01); *B63B 7/08* (2013.01); *B63C 2009/023* (2013.01); *B63C 2009/042* (2013.01); *B63C 2009/044* (2013.01)

(58) Field of Classification Search

CPC ..... B63B 7/08; B63C 9/04; B63C 2009/023; B63C 2009/042; B63C 2009/044

USPC ..... 441/35, 37, 40–42; 114/345

See application file for complete search history.

(56) References Cited

U.S. PATENT DOCUMENTS 2,399,494 A * 4/1946 Manson et al. ..... 441/37
3,843,983 A * 10/1974 Tangen ..... 441/38

(Continued)

FOREIGN PATENT DOCUMENTS

WO 97/02177 A1 1/1997
WO 97/30891 A1 8/1997

OTHER PUBLICATIONS

International Searching Authority, Search Report and Written Opinion issued in corresponding International Application No. PCT/EP2012/059565 dated Aug. 1, 2012, 9 pages.

*Primary Examiner* — S. Joseph Morano
*Assistant Examiner* — Andrew Polay
(74) *Attorney, Agent, or Firm* — Wood, Herron & Evans, LLP

(57) ABSTRACT

The present invention relates to an inflatable floatable unit (1) for life-saving equipment comprising at least a first inflatable flotation tube layer (2) having an upper (3) and a lower (4) side with a distance between the upper side and the lower side (3, 4), a second inflatable flotation tube layer (5) having an upper (6) and a lower side (7) with a distance between the upper and lower sides (6, 7), the first and second flotation tube layers (2, 5) being adapted to be arranged substantially above each other so that the upper side of the first tube layer is opposite the lower side of the second tube layer, the inflatable tube layers extending circumferentially for providing a substantially ring-shaped area, and a bottom element (8) adapted to provide a bottom to the substantially ring-shaped area.

13 Claims, 3 Drawing Sheets

(56) References Cited

U.S. PATENT DOCUMENTS 4,462,331 A * 7/1984 McCrory ..... 114/345
4,517,914 A 5/1985 Geracitano
4,828,520 A * 5/1989 Baughman et al. ..... 441/40
5,733,158 A * 3/1998 Higginbotham et al. ..... 441/38
6,206,743 B1 * 3/2001 Martin ..... 441/37

* cited by examiner

INFLATABLE UNIT FOR A LIFE-SAVING EQUIPMENT

FIELD OF THE INVENTION

The present invention relates to an inflatable floatable unit for life-saving equipment comprising at least a first inflatable flotation tube layer having an upper and a lower side with a distance between the upper side and the lower side, a second inflatable flotation tube layer having an upper and a lower side with a distance between the upper and lower sides, the first and second flotation tube layers being adapted to be arranged substantially above each other so that the upper side of the first tube layer is opposite the lower side of the second tube layer, the inflatable tube layers extending circumferentially for providing a substantially ring-shaped area, and a bottom element adapted to provide a bottom to the substantially ring-shaped area.

The term "ring-shaped area" is, in this context, to be construed as the tubes defining the outer periphery of the life raft, i.e. the hull sides. The ring-shaped area is the area wherein the evacuated people are located while they are present in the life raft. The configuration of the ring-shaped area may be round, elliptic, rectangular, pentagonal, hexagonal, octagonal, or be otherwise shaped as long as the flotation layers completely surround the ring-shaped area.

BACKGROUND ART

In chapter III, SOLAS determines that certain types of vessels must carry life rafts on board which are automatically self-righting so that the life rafts upon inflation, in case the vessel is sinking, will automatically turn to the designed position when they inflate. The specific requirements applying to the function and testing of automatically self-righting life rafts are set out in the IMO resolution MSC.48(66) and MSC.81(70), according to which automatically self-righting life rafts should inter alia be self-draining. Furthermore, for all inflatable life rafts it is required that the bottoms of the life rafts shall be made with a type of insulation, and that the necessary bollard pull required to tow the rafts at a speed of 2 and 3 knots, respectively, must be determined by means of testing and be stated on the life raft certificate. The latter requirement results from the life rafts having to be towable from a sinking vessel by means of the MOB/FRC boats of the vessel or by the lifeboats. This means that the authority approving the evacuation equipment of the vessel must ensure that the lifeboats may exhibit the bollard pull required to tow the biggest life raft on the vessel. Especially in the case of large life rafts, a high bollard pull is required, meaning that the MOB/FRC boats must be designed with large engine powers in order to ensure compliance with the requirements.

Hence, there is a need for an inflatable floatable unit which meets all the above statutory requirements as well as other requirements.

SUMMARY OF THE INVENTION

It is an object of the present invention to wholly or partly overcome the above disadvantages and drawbacks of the prior art. More specifically, it is an object to provide an improved inflatable floatable unit, which is self-draining, which has a low bollard pull as well as a bottom of the inflatable unit which is isolated from direct contact with the seawater.

The above objects, together with numerous other objects, advantages, and features, which will become evident from the below description, are accomplished by a solution in accordance with the present invention by an inflatable floatable unit for life-saving equipment comprising at least a first inflatable flotation tube layer having an upper and a lower side with a distance between the upper side and the lower side, a second inflatable flotation tube layer having an upper and a lower side with a distance between the upper and lower sides, the first and second flotation tube layers being adapted to be arranged substantially above each other so that the upper side of the first tube layer is opposite the lower side of the second tube layer, the inflatable tube layers extending circumferentially for providing a substantially ring-shaped area, and a bottom element adapted to provide a bottom to the substantially ring-shaped area, wherein the bottom element comprises a first bottom layer and a second bottom layer, both bottom layers substantially covering the entire ring-shaped area, the first bottom layer being connected with the inflatable unit between the first and second flotation tube layers, the second bottom layer being connected with the lower side of the first flotation tube layer, and both bottom layers being connected with each other at least at a centre point of the ring-shaped area, the first and second bottom layers having a mutual distance at the centre point being less than the distance between the upper and lower sides of the first flotation tube layer so that at least the second bottom layer has an inclined extension from the lower side of the first flotation tube layer to the centre point.

Hereby, a floatable unit is obtained where the bottom is elevated in relation to the sea level, so that the bottom will not be in contact with the sea even when the evacuated persons by means of their weight force the bottom downwards. Thus, it is avoided that the evacuated persons present in the floatable unit will be directly cooled by the sea, hence minimising the risk of hyperthermia in the evacuated persons. Furthermore, by inclining the second bottom layer, the overall resistance coefficient (i.e. $C_d$) of the floatable unit in the water is reduced considerably in relation to other floatable units having an elevated bottom, and thereby also the towing force or bollard pull of the floatable unit is reduced. It is then possible to tow the floatable unit away from the vessel or ship with less force, allowing smaller boats having less power to assist in such towing. Additionally, an inflatable floatable unit is obtained which fulfil the statutory requirements and which is still inexpensive to manufacture.

In one embodiment, the first bottom layer may have an inclined extension from the upper side of the first flotation tube layer to the centre point, so that fluid present inside the floatable unit may flow towards the centre point, the inclined extension being less steep than the inclined extension of second bottom layer.

In another embodiment, a drain may be arranged at the centre point between the first and second bottom layers so that fluid present inside the floatable unit can be drained out of the floatable unit. Hereby, it is possible to drain the floatable unit so that the floatable unit becomes dry, and consequently the evacuated persons present inside the floatable unit may be kept dry, reducing the risk of hyperthermia to a minimum.

Further, the drain may have an inlet and an outlet, the outlet being positioned above sea level. Moreover, the drain may manually be closed for instance in circumstances where the floatable unit has been emptied from fluid.

Also, the drain may comprise a one-way valve.

Additionally, the first bottom layer may be above sea level.

Moreover, an area of the second bottom layer positioned around the centre point of the ring-shaped area may be positioned above sea level.

In one embodiment, the mutual distance between the first and second bottom layers at the centre point of the ring-shaped area may be at least 0.02 m, preferably above 0.05 m.

In another embodiment, the ring-shaped area may be divided into a plurality of sections, each section having a centre point at which the first and second bottom layers are connected, a drain being arranged in connection with each centre point.

Said sections may be defined by stiffening elements extending in a transverse direction of the inflatable floatable unit.

Moreover, a one-way valve may be arranged in the first bottom layer enabling air to escape from the space, for instance during packing of the floatable unit in a deflated state.

Further, an anti-vacuum system may be arranged in connection with the bottom element, enabling air to pass to and from a space between the first and second bottom layers. Hereby, it is obtained that air may pass into the space between the two bottom layers during the inflating of the floatable unit. Furthermore, the anti-vacuum system allows air to freely pass in and out of the space between the two bottom layers in an inflated state of the floatable unit and depending on the motions of the floatable unit on the water. The anti-vacuum system also ensures that water entering the unit during the inflating will not enter the space.

In one embodiment, the floatable unit may be arranged to be self-righting.

In another embodiment, ballast means may be arranged below the first flotation tube layer.

Furthermore, the inflatable tubes and/or bottom element may be made of a polymeric material, such as natural rubber (NR), polyurethane (PU), thermoplastic polyurethane (TPU), butyl rubber (BR), polyvinylchloride (PVC), polychloroprene (CR), polyethylene (PE), or a combination thereof.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
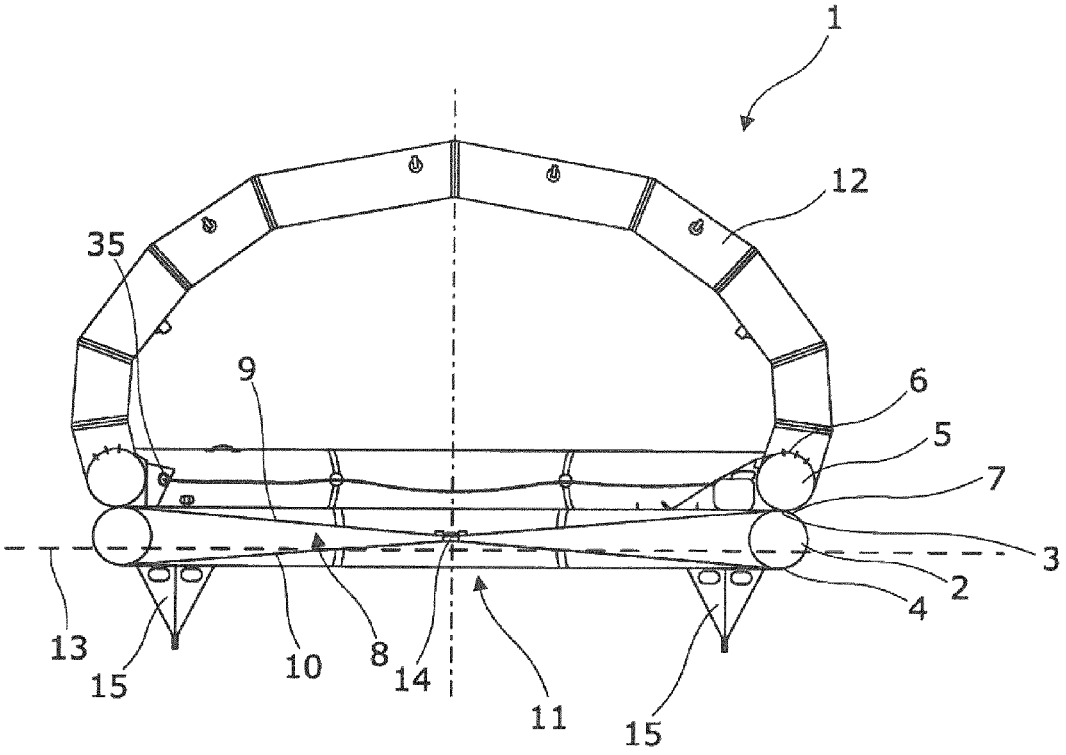
FIG. 1 shows in a cross-sectional view an inflated floatable unit.

FIG. 1 shows an inflatable floatable unit 1 for life-saving equipment such as an inflatable life raft, which in its deflated state is stored in a container onboard a ship or vessel, and which is inflated when deployed into the water. The inflatable floatable unit 1 comprises at least a first inflatable flotation tube layer 2 having an upper side 3 and a lower side 4 with a distance between the upper 3 and lower sides 4, and a second inflatable flotation tube layer 5 having an upper side 6 and a lower side 7 with a distance between the upper 6 and lower sides 7. The first and second flotation tube layers 2, 5 are adapted to be arranged substantially above each other so that the upper side 3 of the first flotation tube layer 2 is opposite the lower side 7 of the second flotation tube layer 5.

The flotation tube layers 2, 5 extend circumferentially for providing a substantially ring-shaped area (not shown). The inflatable floatable unit 1 furthermore comprises a bottom element 8 adapted to provide a bottom to the substantially ring-shaped area. The bottom element 8 comprises a first bottom layer 9 and a second bottom layer 10, both bottom layers 9, 10 substantially covering the entire ring-shaped area. The first bottom layer 9 is connected with the inflatable floatable unit 1 between the first and second flotation tube layers 2, 5, and the second bottom layer 10 is connected with the lower side 4 of the first flotation tube layer 2. Both bottom layers 9, 10 are connected with each other at least at a centre point 11 of the ring-shaped area, and the first and second bottom layers 9, 10 have a mutual distance at the centre point 11 being less than the distance between the upper and lower sides 3, 4 of the first flotation tube layer 2 so that at least the second bottom layer 10 has an inclined extension from the lower side 4 of the first flotation tube layer 2 to the centre point 11.

The inflatable floatable unit 1 also comprises inflatable canopy support members 12 which extend upwards from one side of the second flotation tube layer 5 to another side, substantially in a "flattened" circle shape. The inflatable support members 12 also extend slightly outwards so that the support members 12 have a larger width than the flotation tube layers 2, 5, allowing the inflatable floatable unit 1 to be self-righting, i.e. the inflatable floatable unit 1 is capable of turning itself to the designed correct position (the first flotation tube layer 2 closest to the water), even though it is being inflated upside down. Since the support members 12 have a larger width than the rest of the inflatable floatable unit 1, the design and buoyancy of the support members 12 will facilitate the turning of the inflatable floatable unit 1 when it is placed upside down in the water.

In FIG. 1, the dotted line 13 depicts the sea level when the inflatable floatable unit 1 is floating in the water. At least the centre point 11 of the bottom element 8 is at any time above sea level. Preferably, the first bottom layer 9 is also at any time positioned above sea level, causing the persons present in the inflatable floatable unit 1 to be elevated above the sea level hence avoiding to be cooled down by the temperature of the water. This is especially advantageous if the inflatable floatable unit 1 is deployed in arctic environments.

Furthermore, a drain 14 is arranged at the centre point 11 between the first and second bottom layers 9, 10 so that fluid present inside the floatable unit 1 can be drained out of the floatable unit 1. The drain 14 will be described in more detail in connection with FIG. 5 below. Moreover, an anti-vacuum system 35 is shown, which will be described in more detail in connection with FIG. 5 below.

Below the first flotation tube layer 2, ballast means 15 is arranged around the extension of the tube layer 2. The ballast means 15 may for instance be bags having holes so that water may flow into the bag when the bag is submerged in the water. Hence, the bag is filled with water, allowing the bag to function as ballast for the floatable unit 1.

Figure 2:
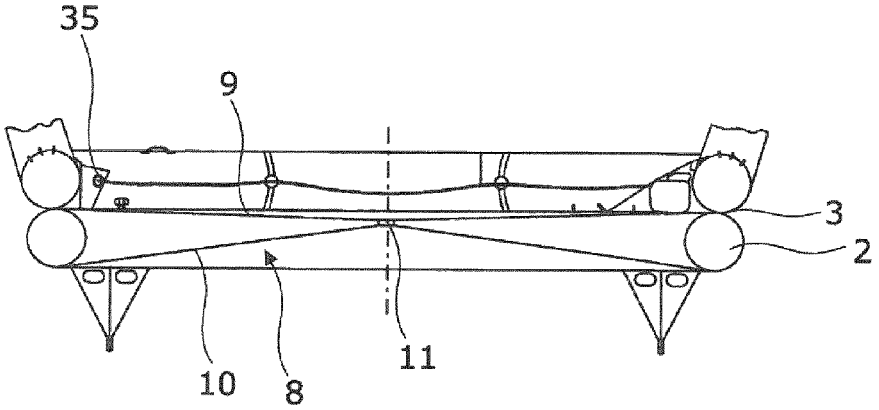
FIG. 2 shows a part of an embodiment of an inflated floatable unit in a cross-sectional view.

FIG. 2 shows an enlarged view of a bottom element 11, wherein the first bottom layer 9 has an inclined extension from the upper side 3 of the first flotation tube layer 2 to the centre point 11, so that the fluid present inside the floatable unit 1 may flow towards the centre point 11. In the shown embodiment, the inclined extension of the first bottom layer 9 is less steep in relation to the inclined extension of second bottom layer 10.

Figure 3:
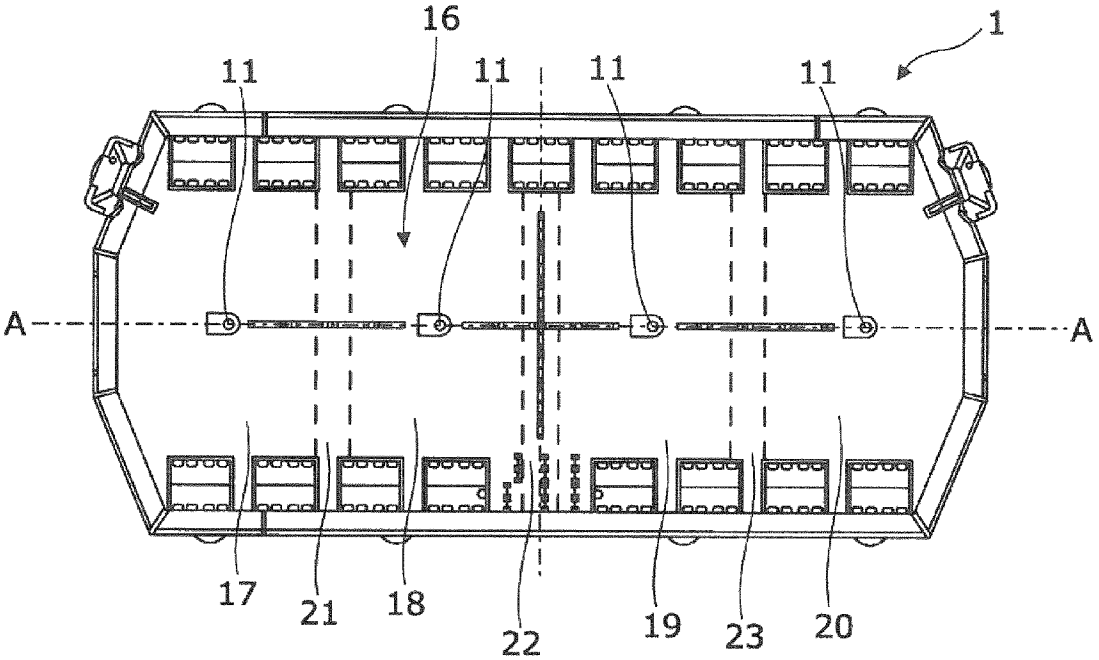
FIG. 3 is a bottom view of an inflated floatable unit being divided into sections.
Figure 4:
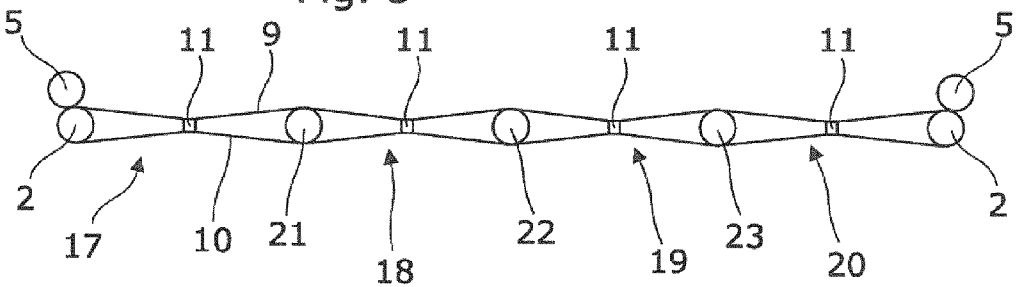
FIG. 4 shows a cross-sectional view taken along A-A in FIG. 3.

FIG. 3 shows a bottom view of an inflatable floatable unit 1 having a large evacuation capacity. The ring-shaped area 16 is divided into a plurality of sections, in the shown embodiment four sections 17, 18, 19, 20. Each section 17, 18, 19, 20 has a centre point 11 at which the first and second bottom layers (not shown) are connected. The sections 17, 18, 19, 20 are defined by stiffening elements 21, 22, 23 (depicted in dotted lines) extending in a transverse direction of the inflatable floatable unit 1. The stiffening elements 21, 22, 23 may be inflatable tubes extending across the ring-shaped area 16 and being connected with the first flotation tube layer 2. FIG. 4 shows a cross-sectional view of the inflatable floatable unit 1 of FIG. 3 taken along A-A wherein it is shown that the first and second bottom layers 9, 10 incline towards the centre point 11 in each section 17, 18, 19, 20. Furthermore, a drain may be arranged in each centre point.

Figure 5:
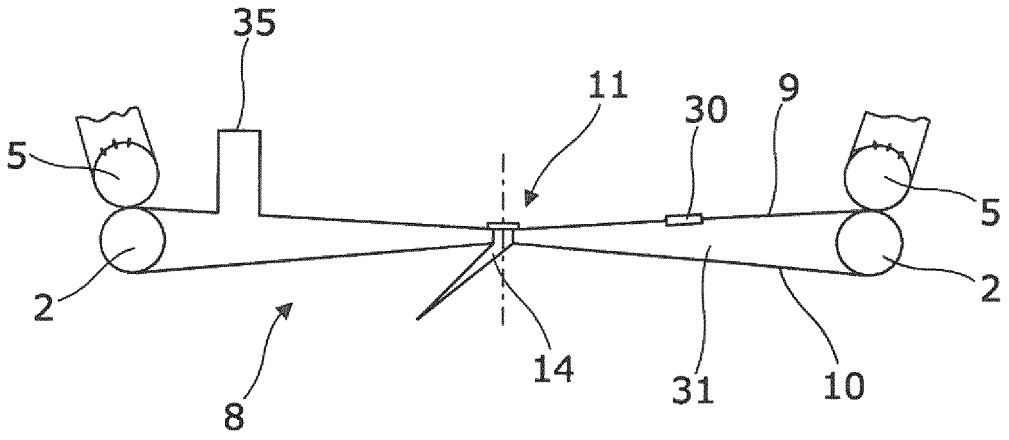
FIG. 5 shows, in a cross-sectional view, the drain arranged at centre point as well as the anti-vacuum system.

In FIG. 5 a more detailed view of the bottom element 8 is shown. As mentioned above, the drain 14 may be a one-way valve, for instance made of a flexible material, or being a drainage tube also made of a flexible material. In the shown embodiment in FIG. 5, it applies that for the drain 14 to function properly, the outlet of the drain 14 should preferably be above sea level (not shown). In other embodiments, the drain 14 may comprise one-way valves made of a rigid or semi-rigid material. However, at present, valves made of a flexible material are preferred since they are most reliable and do no damage the unit, when it is in a deflated state.

Further an anti-vacuum system 35 is shown, which comprises anti-vacuum tubes arranged along the periphery of the bottom element, said anti-vacuum tubes preferably being rubber tubes having a diameter of approximately 10 cm and being elevated approximately 30 cm from the bottom in such a manner that a vacuum cannot be established beneath the inflatable floatable unit. The anti-vacuum system also secures that air may pass between the first and second bottom layers 9, 10 during the inflating of the inflatable unit. At the same time it secures that no water will be able to flow into the space 31 between the two bottom layers 9, 10.

In connection with the first bottom layer 9 an additional one-way valve 30 is arranged for letting air out of the space 31 between the first and second bottom layers 9, 10. Hereby, packing of the deflated unit is facilitated.

Although the invention has been described in the above in connection with preferred embodiments of the invention, it will be evident for a person skilled in the art that several modifications are conceivable without departing from the invention as defined by the following claims.

The invention claimed is:

1. An inflatable floatable unit for life-saving equipment comprising at least a first inflatable flotation tube layer having an upper and a lower side with a distance between the upper side and the lower side, a second inflatable flotation tube layer having an upper and a lower side with a distance between the upper and lower sides, the first and second flotation tube layers being adapted to be arranged substantially above each other so that the upper side of the first tube layer is opposite the lower side of the second tube layer, the inflatable tube layers extending circumferentially for providing a substantially ring-shaped area, and a bottom element adapted to provide a bottom to the substantially ring-shaped area, wherein the bottom element comprises a first bottom layer and a second bottom layer, both bottom layers substantially covering the entire ring-shaped area, the first bottom layer being connected with the inflatable unit between the first and second flotation tube layers, the second bottom layer being connected with the lower side of the first flotation tube layer, and both bottom layers being connected with each other at least at a centre point of the ring-shaped area, the first and second bottom layers having a mutual distance at the centre point being less than the distance between the upper and lower sides of the first flotation tube layer so that at least the second bottom layer has an inclined extension from the lower side of the first flotation tube layer to the centre point.

2. The inflatable floatable unit according to claim 1, wherein the first bottom layer has an inclined extension from the upper side of the first flotation tube layer to the centre point.

3. The inflatable floatable unit according to claim 1, wherein a drain is arranged at the centre point between the first and second bottom layers so that fluid present inside the floatable unit can be drained out of the floatable unit.

4. The inflatable floatable unit according to claim 3, wherein the drain has an inlet and an outlet, the outlet being positioned above sea level.

5. The inflatable floatable unit according to claim 3, wherein the drain comprises a one-way valve.

6. The inflatable floatable unit according to claim 1, wherein an area of the second bottom layer positioned around the centre point of the ring-shaped area is positioned above sea level.

7. The inflatable floatable unit according to claim 1, wherein the mutual distance between the first and second bottom layers at the centre point of the ring-shaped area is at least 0.02 m, preferably above 0.05 m.

8. The inflatable floatable unit according to claim 1, wherein the ring-shaped area is divided into a plurality of sections, each section having a centre point at which the first and second bottom layers are connected, a drain being arranged in connection with each centre point.

9. The inflatable floatable unit according to claim 8, wherein the sections are defined by stiffening elements extending in a transverse direction of the inflatable floatable unit.

10. The inflatable floatable unit according to claim 1, wherein an anti-vacuum system is arranged in connection with the bottom element, enabling air to pass to and from a space between the first and second bottom layers.

11. The inflatable floatable unit according to claim 1, wherein the floatable unit is arranged to be self-righting.

12. The inflatable floatable unit according to claim 1, wherein ballast means is arranged below the first flotation tube layer.

13. The inflatable floatable unit according to claim 1, wherein the inflatable tubes and/or bottom element are made of a polymeric material, such as natural rubber (NR), polyurethane (PU), thermoplastic polyurethane (TPU), butyl rubber (BR), polyvinylchloride (PVC), polychloroprene (CR), polyethylene (PE), or a combination thereof.

* * * * *